US011758955B2

(12) United States Patent
Kawamura et al.

(10) Patent No.: US 11,758,955 B2
(45) Date of Patent: Sep. 19, 2023

(54) PROTECTOR

(71) Applicant: TOYODA GOSEI CO., LTD., Kiyosu (JP)

(72) Inventors: Yusuke Kawamura, Kiyosu (JP); Wataru Miura, Kiyosu (JP); Toshihito Yanagisawa, Kiyosu (JP); Hitomi Takahashi, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 43 days.

(21) Appl. No.: 17/469,190

(22) Filed: Sep. 8, 2021

(65) Prior Publication Data

US 2022/0095713 A1 Mar. 31, 2022

(30) Foreign Application Priority Data

Sep. 30, 2020 (JP) ..... 2020-165661

(51) Int. Cl.
*A41D 13/05* (2006.01)
*A41D 13/015* (2006.01)

(52) U.S. Cl.
CPC ..... *A41D 13/0506* (2013.01); *A41D 13/0155* (2013.01); *A41D 13/0556* (2013.01)

(58) Field of Classification Search
CPC ..... A41D 13/0155; A41D 13/0506; A41D 13/0556; A41D 13/018; A63B 71/081; B63C 9/081; B63C 9/125; B63C 9/15; B63C 9/155; B63C 9/18
See application file for complete search history.

(56) References Cited

U.S. PATENT DOCUMENTS 4,737,994 A * 4/1988 Galton ..... A41D 13/0506 2/DIG. 3
5,997,520 A * 12/1999 Ahr ..... A61F 13/49009 604/385.12
7,891,026 B1 * 2/2011 Smith ..... A41D 13/0506 2/465

FOREIGN PATENT DOCUMENTS

| | | | |
|---|---|---|---|
| CN | 103689828 | A | 4/2014 |
| JP | 2011-52329 | A | 3/2011 |
| WO | 2019/207474 | A1 | 10/2019 |

* cited by examiner

*Primary Examiner* — F Griffin Hall
(74) *Attorney, Agent, or Firm* — POSZ LAW GROUP, PLC

(57) ABSTRACT

A protector for protecting a targeted body part of the wearer is disclosed. The protector includes a mounting belt that is adapted to put on the body of the wearer, and at least one protective body that is adapted to cover the targeted body part when the protector is worn, the protective body extending from the mounting belt. The protective body includes a protective pad that substantially has a board shape, an airbag that is overlaid on an outer surface of the protective pad in a stacking manner and configured to be inflated with an inflation gas, and an outer cover that covers outer circumferences of the protective pad and the airbag as stacked one on another. At least a part of an outer circumferential edge of the airbag is joined to the protective pad so that the airbag will not float away from the protective pad when inflated.

14 Claims, 9 Drawing Sheets

PROTECTOR

CROSS REFERENCE TO RELATED APPLICATIONS

The present application claims priority from Japanese Patent Application No. 2020-165661 of Kawamura et al., filed on Sep. 30, 2020, the entire disclosure of which is incorporated herein by reference.

BACKGROUND

1. Technical Field

The present disclosure relates to a protector that is adapted to be worn by a wearer for covering and protecting a targeted body part of the wearer.

2. Description of Related Art

CN103689828A discloses a protector that is adapted to be worn by a wearer such as an elderly person for covering and protecting one or more targeted body parts of the wearer. The protector is formed by mounting at least one set of a protective pad and an airbag stacked one on another on a garment (an upper garment or a lower garment) to be worn by the wearer. Thus the protector is configured to cover and protect the targeted body part with the protective pad and the airbag as inflated on the outer side of the protecting pad. WO 2019/207474 A1 discloses a protector that is designed to be put on around the hip of a wearer and deploy an airbag for protecting their hip when activated.

The protector disclosed in the former literature is able to protect the targeted body part steadily with the protective pad and the airbag as inflated on the outer side of the protective pad. However, since the protective pad and the airbag are integral with the garment, this protector would not be easy to put on. The protector disclosed in the latter literature is easy to put on since it is adapted to be wrapped around a body part in a vicinity of the targeted body part. Accordingly, it is conceivable to apply the configuration of the protector of the former literature to the protector of the latter literature. However, since the airbag is likely to float away from the protective pad when inflated, there is a room for improvement in covering and protecting the targeted body part steadily with the airbag and the protective pad.

SUMMARY

An exemplary embodiment in the present disclosure relates to a protector that is adapted to be worn by a wearer for protecting a targeted body part of the wearer. The protector includes a mounting belt that is adapted to put on the body of the wearer, and at least one protective body that is adapted to cover the targeted body part when the protector is worn, the protective body extending from the mounting belt. The protective body includes: a protective pad that substantially has a board shape; an airbag that is overlaid on an outer surface of the protective pad in a stacking manner, the airbag being configured to be inflated with an inflation gas when the protector is actuated; and an outer cover that covers outer circumferences of the protective pad and the airbag as stacked one on another. At least a part of an outer circumferential edge of the airbag is joined to the protective pad so that the airbag will not float away from the protective pad when inflated.

DETAILED DESCRIPTION

Exemplary embodiments of the present disclosure are described below with reference to the accompanying drawings. However, the invention is not limited to the embodiments disclosed herein. All modifications within the appended claims and equivalents relative thereto are intended to be encompassed in the scope of the claims.

Figure 1:
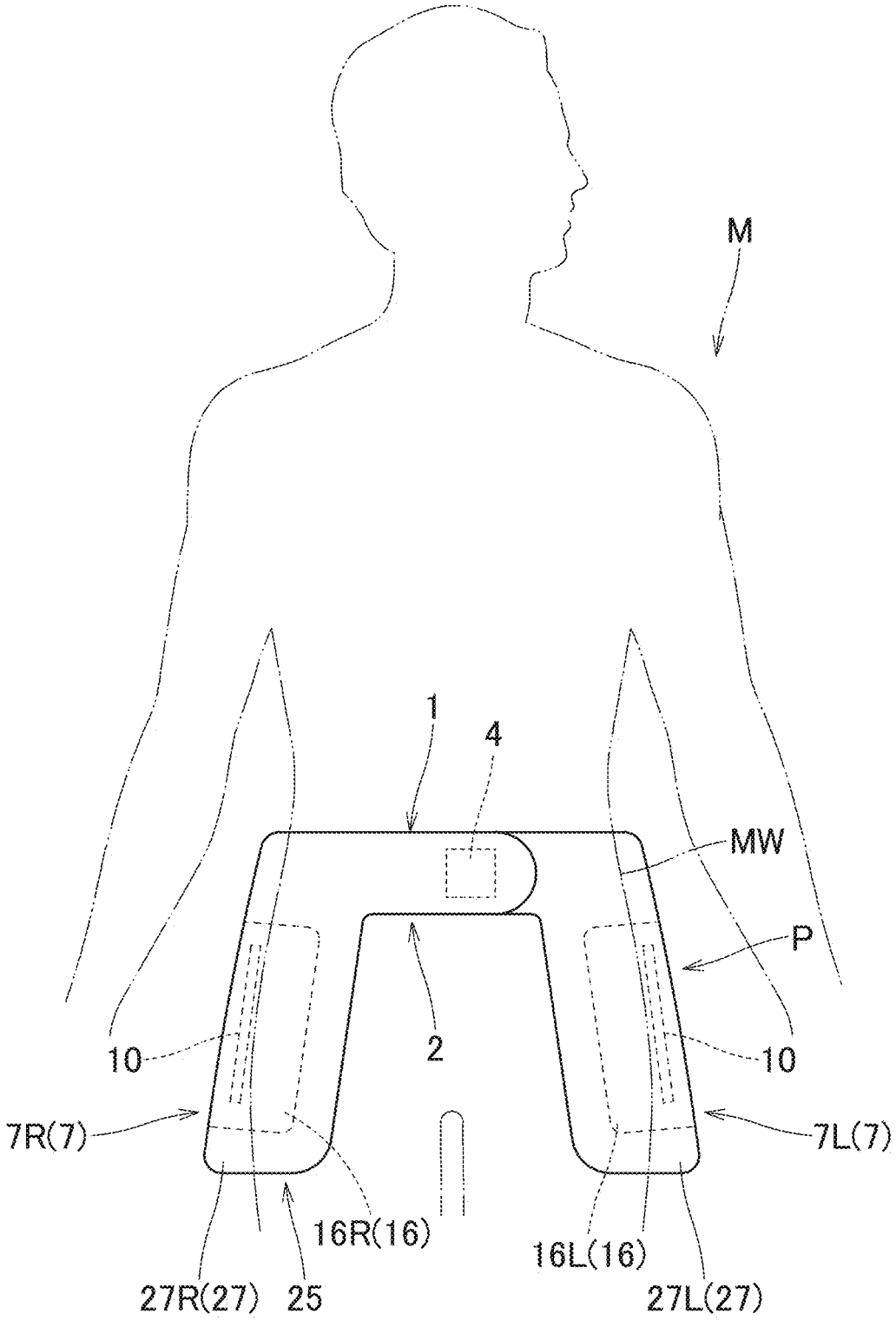
FIG. 1 schematically depicts a protector in accordance with an exemplary embodiment as worn by a wearer.

A protector P in accordance with an exemplary embodiment is configured to be wrapped around the hip MW (more particularly, around the pelvis MP) of a wearer M for protecting sides of the bases of the femurs TB (i.e. the trochanters TP of femurs) as targeted body parts, as can be seen in FIG. 1. Unless otherwise specified, up-down, front-rear, and left-right directions in this exemplary embodiment are intended to refer to up-down, front-rear, and left-right directions as viewed from the wearer M wearing the protector P.

As can be seen in FIGS. 1 to 5, the protector P includes a mounting belt 1, two protective bodies 7 (7L, 7R) that respectively extend from the mounting belt 1, a gas generator 20 for feeding an inflation gas to a later-described airbag 13 of each of the protective bodies 7 (7L, 7R), and an operation control device 22 that includes a sensor part 23 for detecting a fall of the wearer M and is configured to actuate the gas generator 20.

The operation control device 22 includes a sensor part 23 that includes an angular velocity sensor capable of sensing angular velocities around three axes in up and down, front and rear, and left and right directions, and an acceleration sensor capable of sensing accelerations in the three-axis directions. The operation control device 22 is configured to actuate the gas generator 20 in response to a signal fed from the sensor part 23 as has sensed a falling behavior different from a normal behavior of the wearer M. More particularly, the operation control device 22 includes a determining means that is configured to determine based on various thresholds, and is configured to actuate the gas generator 20 upon sensing a fall of the wearer M based on the determination by the determining means. The operation control device 22 further includes a power source composed of a not-shown battery or the like for operation of the sensor part 23 and for emission of an actuating signal to the gas generator 20.

Figure 9:
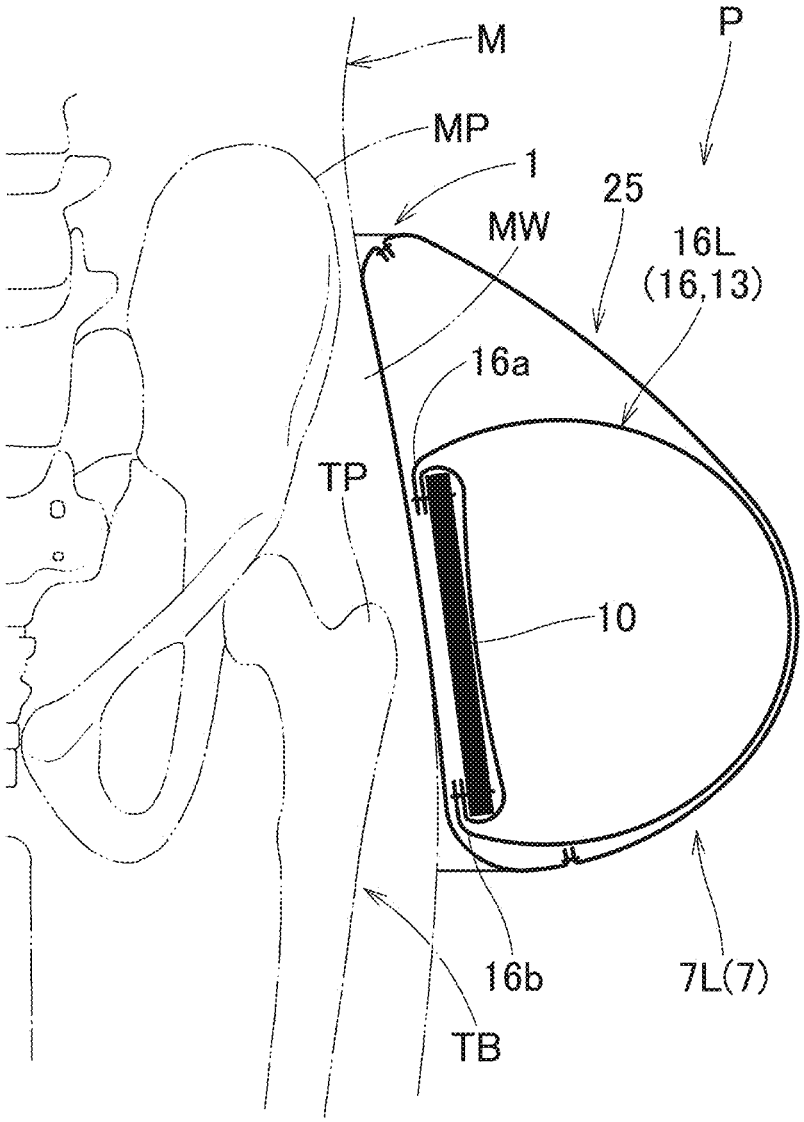
FIG. 9 is a schematic vertical sectional view of the protector of the exemplary embodiment at full inflation of the airbag in a worn state.

Each of the protective bodies 7 (7L, 7R) includes a protective pad 10, an airbag 13 that is overlaid on an outer surface of the protective pad 10 in a stacking manner, and an outer cover 25 that covers outer circumferences of the protective pad 10 and the airbag 13 as stacked one on another. As can be seen in FIG. 9, each of the protective bodies 7 (7L, 7R) is configured to cover the outer side of the base of the left/right femur TB (i.e. the trochanter TP of femur) of the wearer M when the mounting belt 1 is put on around the pelvis MP of the wearer M.

The mounting belt 1 includes a belt body 2 that is formed into a band, connects the two protective bodies 7L, 7R together at upper ends of the protective bodies 7L, 7R and further extends outwardly in a left and right direction, and a fastening element 4 that is used to make the belt body 2 stay on the wearer M. The belt body 2 of this specific embodiment is composed of a belt-forming portion 26 of the outer cover 25. A later-described gas-feeding channel 15 of the airbag 13 is disposed inside the belt body 2. The fastening element in this embodiment is composed of a hook-and-loop fastener 4 including hooks 4*a* and loops 4*b* engageable with one another to fasten the opposite ends 2*a* and 2*b* of the belt body together. With the hook-and-loop fastener 4, the wearer M is able to put on the protector P easily according to the size of the waist.

Figure 8:
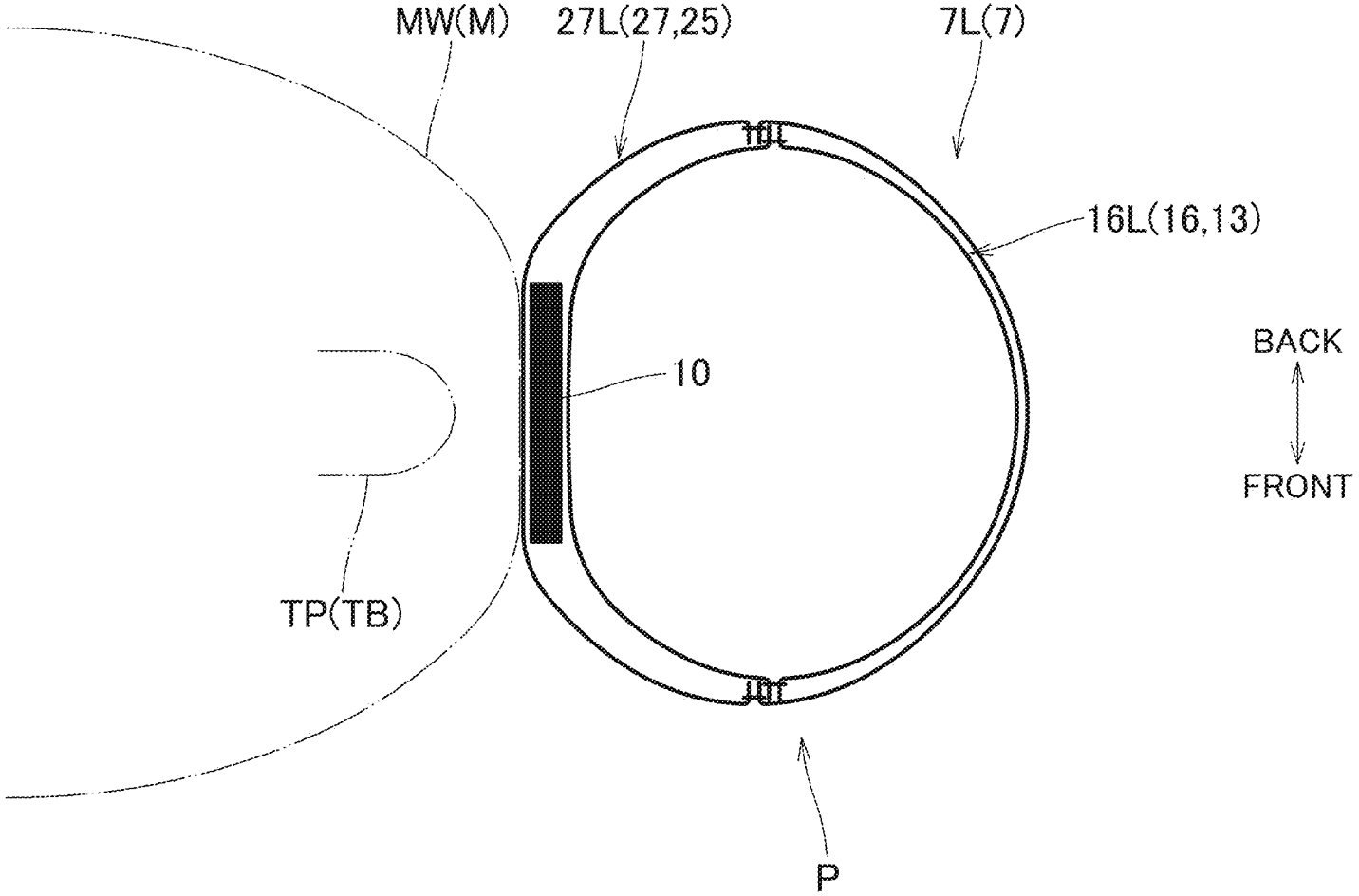
FIG. 8 is a schematic partial horizontal sectional view of the protector of the exemplary embodiment taken along a front and rear direction at full inflation of the airbag, which shows a left portion of the protector.

The protective pad 10 is disposed in each of the protective bodies 7 (7L, 7R). The protective pad 10 is formed substantially into a board shape and has flexibility. Moreover, the protective pad 10 has such hardness and cushioning property that enables the protective pad 10 to protect a vicinity of the base of the femur TB (i.e. the trochanter TP of femur) upon impact thereon in the event of a fall or the like of the wearer M. The protective pad 10 of this specific embodiment is formed from synthetic resin such as urethane resin into a substantially rectangular board shape that has a wide width in an up and down direction so as to amply cover the trochanter TP of femur as the targeted body part and surroundings. As can be seen in FIGS. 8 and 9, the protective pad 10 is configured to cover the outer (i.e. left/right) side of the trochanter TP of femur amply both in the front and rear direction and in the up and down direction when the mounting belt 1 is put on around the pelvis MP. More specifically, the protective pad 10 has a thickness t (FIG. 3) within the range of 5 to 10 mm, a width W1 (FIG. 5) in the left and right direction (in other words, in the front and rear direction in a worn state) within the range of 60 to 120 mm, and a width L1 (FIG. 5) in the up and down direction within the range of 160 to 200 mm. In various embodiments, the width W1 may be within the range of 80 to 100 mm, and the width L1 may be within the range of 160 to 180 mm. As will be described later, the upper end 16*a* and lower end 16*b* of a later-described bag body 16 (16L, 16R) of the airbag 13 are respectively joined to the upper end 10*a* and lower end 10*b* of the protective pad 10. The protective pad 10 is designed not to bend in the up and down direction but stay in a flat board shape even at deployment of the bag body 16 (16L, 16R).

Figure 3:
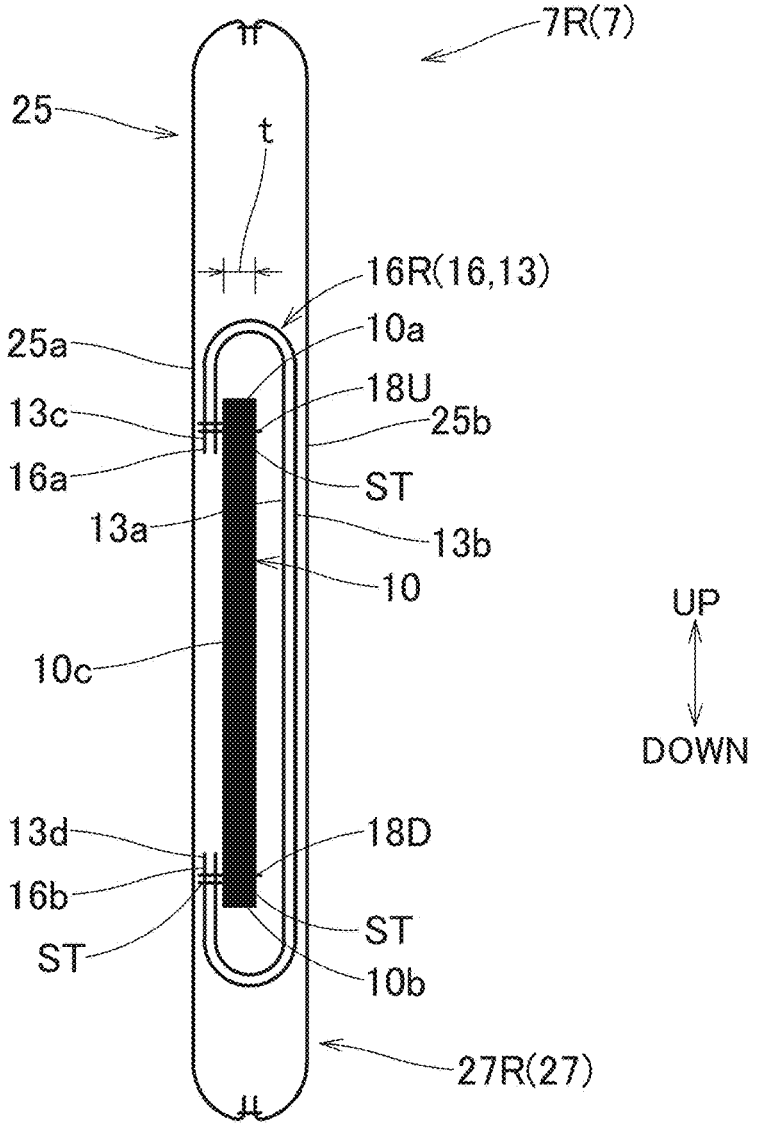
FIG. 3 is a schematic vertical sectional view of the protector of the exemplary embodiment taken along line III-III of FIG. 2.
Figure 4:
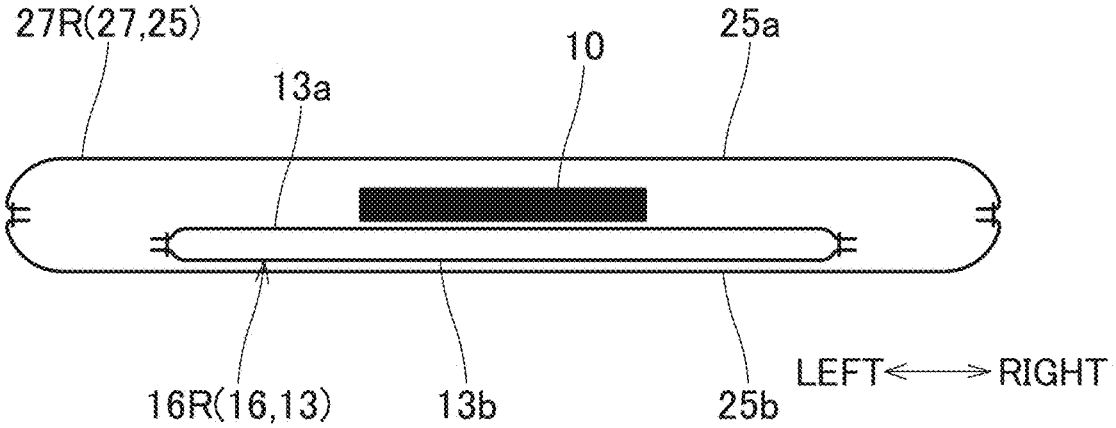
FIG. 4 is a schematic horizontal sectional view of the protector of the exemplary embodiment taken along line IV-IV of FIG. 2.
Figure 5:
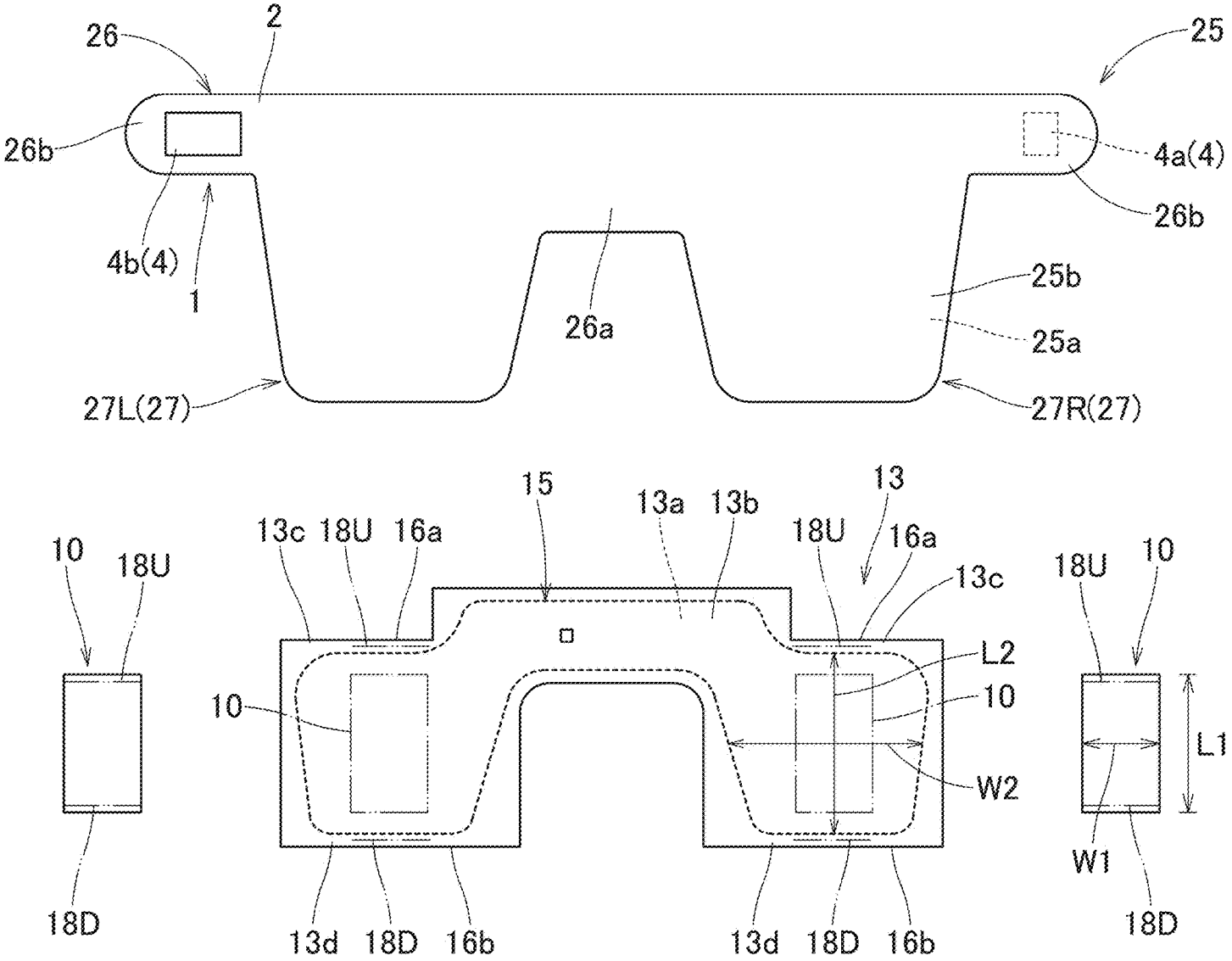
FIG. 5 depicts an outer cover, an airbag and a protective pad of the protector of the exemplary embodiment by plan.
Figure 6:
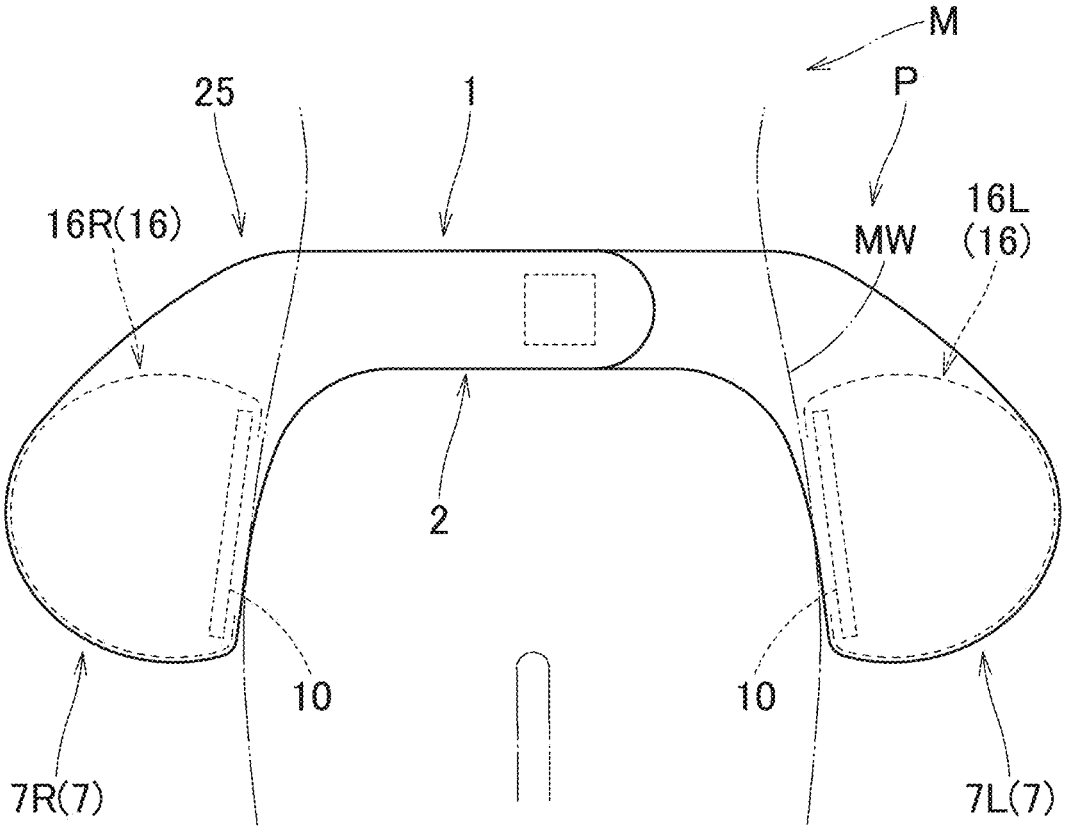
FIG. 6 schematically depicts the protector of the exemplary embodiment at airbag deployment in a worn state.

The airbag 13 is made of a sheet material having flexibility. The airbag 13 of this specific embodiment is made of a fabric woven with polyester yarns, polyamide yarns or the like. As can be seen in FIGS. 3 to 5, the airbag 13 includes an inner wall 13*a* that is disposed at an inner side (i.e. towards the wearer M or towards the protective pad 10) when worn, and an outer wall 13*b* that is disposed on the outer side when worn. The airbag 13 is formed by sewing (or jointing) outer circumferential edges of the inner wall 13*a* and outer wall 13*b* together into a bag, as shown in FIGS. 3 to 5. The airbag 13 may be formed by OPW technology. As shown in FIG. 5, the airbag 13 includes two bag bodies 16 (16L, 16R) that form the protective bodies 7L, 7R, respectively, and a gas-feeding channel 15 that provides gas communication between the bag bodies 16 (16L, 16R) at a vicinity of the upper ends 16*a* of the bag bodies 16. The airbag 13 as laid flat is bilaterally symmetrical.

Figure 2:
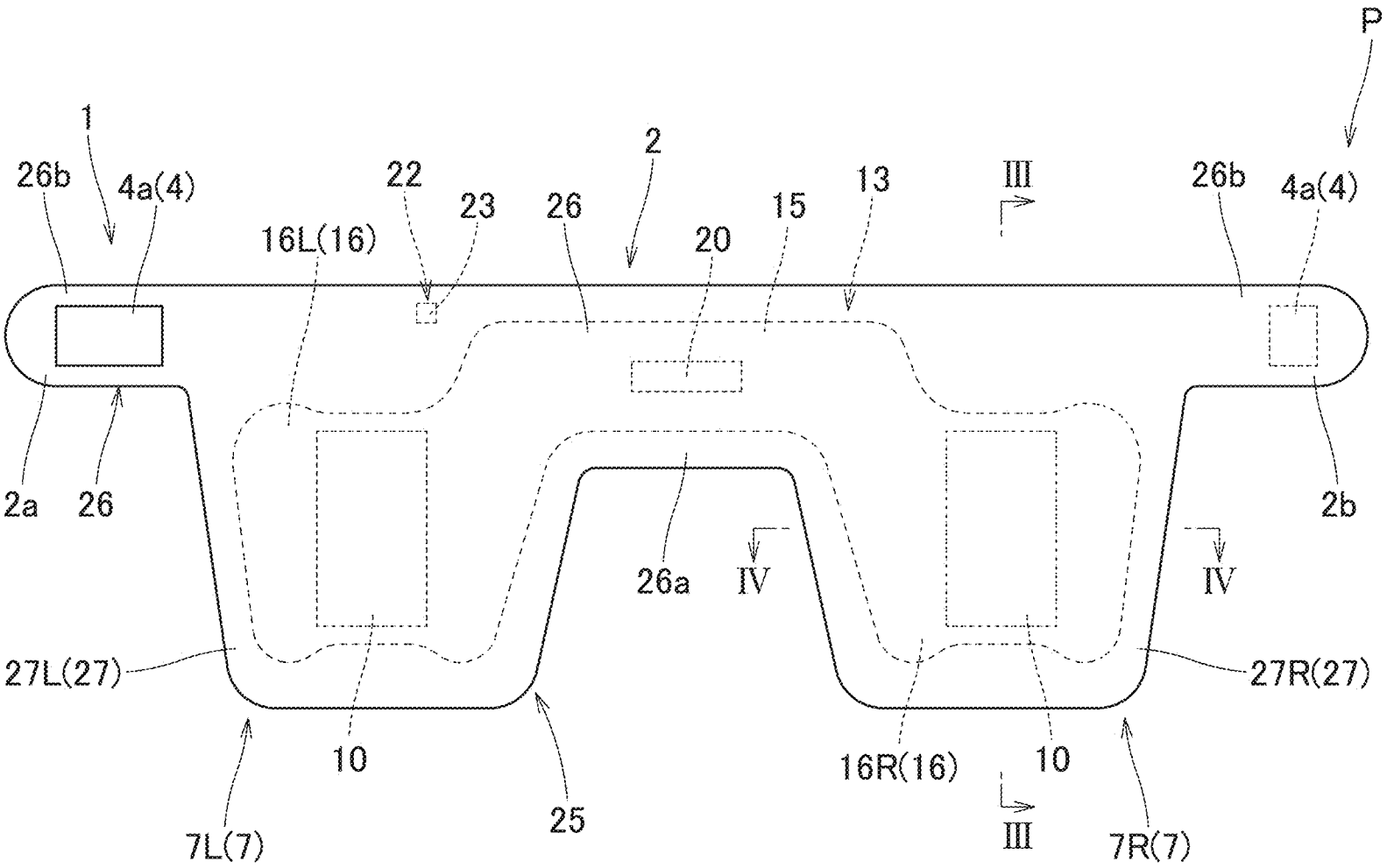
FIG. 2 is a plan view of the protector of the exemplary embodiment as laid flat.

The gas-feeding channel 15 is designed to be inflated into a rod shape elongated substantially along a left and right direction. As described above, the gas-feeding channel 15 is disposed inside the belt body 2 of the mounting belt 1, and is configured to be deployed at the back of the pelvis MP of the wearer M though not depicted in detail. In this embodiment, the gas generator 20 is connected to the gas-feeding channel 15 for feeding the airbag 13 with an inflation gas (FIG. 2). Although not depicted in detail, the gas generator 20 is disposed in a vicinity of the center in the length direction of the gas-feeding channel 15. The gas generator 20 contains a compressed gas, and is designed to discharge a cold gas into the airbag 13 when actuated and unsealed. The gas generator 20 is electrically connected with the operation control device 22 and configured to be actuated when fed with an actuating signal from the operation control device 23 as has sensed a fall of the wearer M.

As can be seen in FIG. 5, each of the bag bodies 16 (16L, 16R) is designed such that the upper end 16*a* is disposed at a farther downward position than the upper edge of the gas-feeding channel 15, in a stepped manner with respect to the gas-feeding channel 15. That is, each of the bag bodies 16 (16L, 16R) is designed to be deployed at a lower position than the gas-feeding channel 15 deployed at the back of the pelvis MP, in other words, at a lower position than the pelvis MP, as can be seen in FIG. 9. Each of the bag bodies 16 as laid flat has a substantially trapezoidal outer shape that has a greater width in the front and rear direction than that in the up and down direction, and slightly narrows toward the lower end 16*a*. More particularly, the width in the up and down direction and the width in the left and right direction (i.e. in the front and rear direction in a worn state) of each of the bag bodies 16 (16L, 16R) as laid flat are greater than those of the protective pad 10, as shown in FIG. 5. More specifically, the upper end 16*a* and the lower end 16*b* of the bag body 16 are respectively joined (or sewn) to the upper end 10*a* and the lower end 10*b* of the protective pad 10, as will be described later, and the size of the bag body 16 as laid flat is set so that the bag body 16 covers a substantially entire outer surface of the protective pad 10 at airbag deployment as can be seen in FIGS. 8 and 9, and so that the thickness T (FIG. 7) of the bag body 16 as fully inflated is approximately 150 mm. In this specific embodiment, the width W2 in the left and right direction (i.e. in the front and rear direction in a worn state, FIG. 5) of each of the bag bodies 16 (16L, 16R) as laid flat is approximately twice the width W1 in the front and rear direction of the protective pad 10, and the width L2 (FIG. 5) in the up and down direction of each of the bag bodies 16 as laid flat is approximately 1.4 times the width L1 in the up and down direction of the protective pad 10. The width L2 in the up and down direction of the bag body 16 as laid flat is preferably within the range of 1 to 2 times the width L1 in the up and down direction of the protective pad 10.

Figure 7:
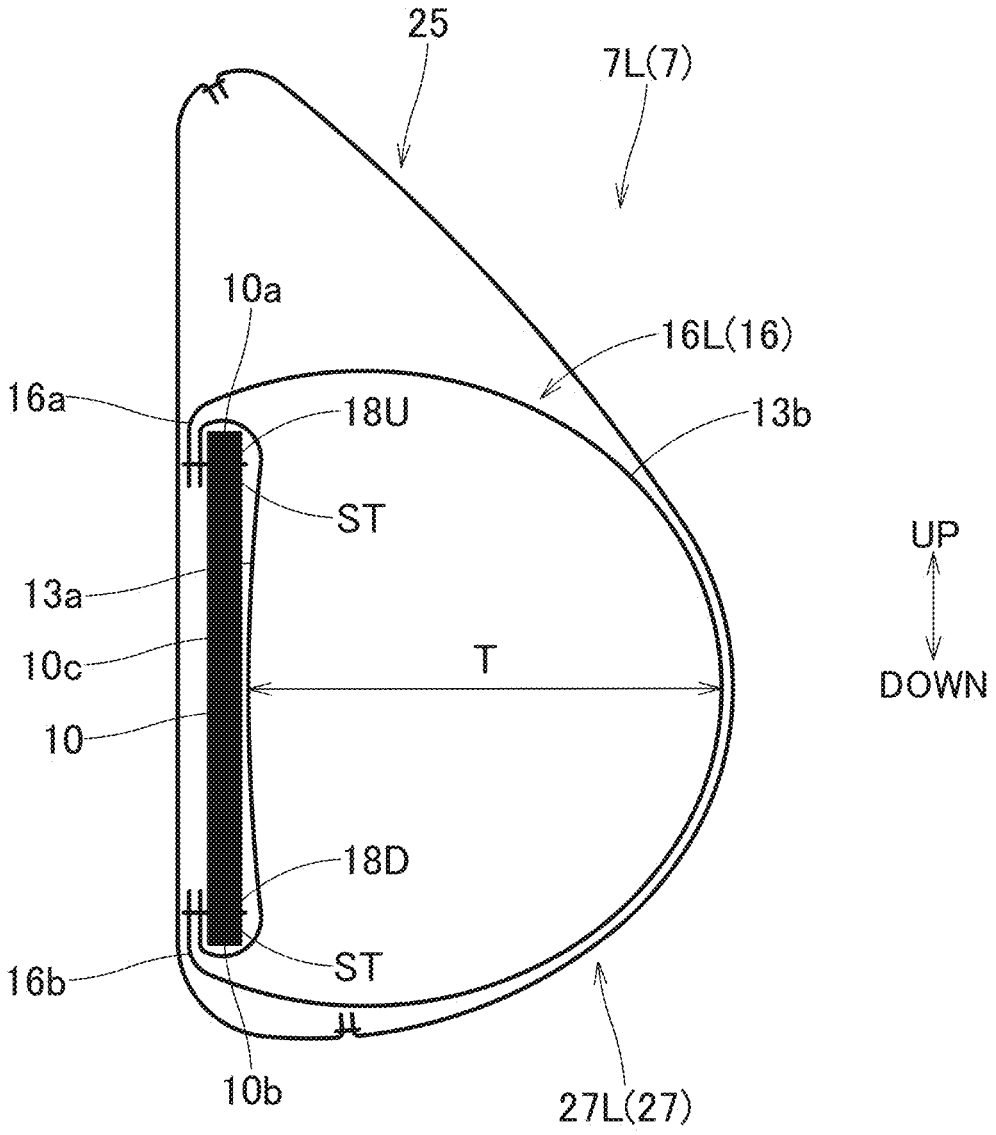
FIG. 7 is a schematic vertical sectional view of the protector of the exemplary embodiment taken along an up and down direction at full inflation of the airbag.

The protective pad 10 and the bag body 16 are joined together by the upper ends 10*a*, 16*a* and lower ends 10*b*, 16*b* in a state in which the centers in the front and rear direction (or in the left and right direction) of the protective pad 10 and bag body 16 are substantially aligned with one another. The bag body 16 is designed to protrude farther forward and backward than the protective pad 10 when fully inflated, as can be seen in FIG. 8. As can be seen in FIGS. 3 and 7, each of the upper end 16*a* and the lower end 16*b* of the bag body 16 is disposed on an inner surface 10*c* of the protective pad 10 in a vicinity of the upper end 10*a*/lower end 10*b* of the protective pad 10 while enfolding the terminal of the upper end 10*a*/lower end 10*b*, and the upper end 16*a* and the lower end 16*b* of the bag body 16 are respectively joined (sewn) to the inner surface 10*c* of the protective pad 10 at vicinities of the upper end 10*a* and lower end 10*b* by an upper joint 18U and a lower joint 18D. More particularly, the airbag 13 has, in the outer circumferential edge, a seam allowance which was formed when the outer circumferential edges of the inner wall 13*a* and outer wall 13*b* were sewn together. In this embodiment, the upper joint 18U joints an upper portion 13*c* of the seam allowance to the inner surface 10*c* of the protective pad 10 with sewing threads ST. Likewise, the lower joint 18D joints a lower portion 13*d* of the seam allowance to the inner surface 10*c* of the protective pad 10 with sewing threads ST. Each of the upper joint 18U and lower joint 18D is continuously formed in a substantially entire area in the front and rear direction (in the left and right direction) of the protective pad 10, as indicated with dashed-and-double-dotted lines in FIG. 5.

The outer cover 25 is made of a flexible woven fabric having better touch than the base cloth of the airbag 13. As can be seen in FIGS. 2 to 4, the outer cover 25 includes a belt-forming portion 26 that forms the belt body 2 of the mounting belt 1, and two main covering portion 27 (27L, 27R) each of which covers the protective pad 10 and the bag body 16. The outer cover 25 includes an inner wall 25*a* that is disposed in the inner side (i.e. towards the wearer M) when worn, and an outer wall 25*b* that is disposed on the outer side when worn, and is formed by jointing (or sewing) outer circumferential edges of the inner wall 25*a* and outer wall 25*b* together. The outer cover 25 as laid flat is bilaterally symmetrical, as can be seen in FIGS. 2 and 5. Inside of an intermediate portion 26*a* of the belt-forming portion 26 disposed between the main covering portion 27 (27L, 27R), there are disposed the gas-feeding channel 15 of the airbag 13 and the gas generator 20, as described above. This intermediate portion 26*a* is greater in width than opposite leading end portions 26*b* of the belt-forming portion 26 which extend outwardly in the left and right direction from the main covering portions 27, as shown in FIG. 2. Each of the main covering portions 27 (27L, 27R) covers the protective pad 10 and the bag body 16 entirely. The widths in the up and down direction and in the left and right direction (i.e. in the front and rear direction in a worn state) of each of the main covering portions 27 (27L, 27R) are greater than those of the bag body 16 so as to allow the bag body 16 to be inflated smoothly inside the main covering portion 27.

The protector P in accordance with the exemplary embodiment is put on the wearer 1 by being wrapped around the pelvis MP by the mounting belt 1 with the use of the hook-and-loop fastener 4 as the fastening element. If the sensor part 23 detects a falling behavior of the wearer M as wearing the protector P, the operation control device 22 sends an actuating signal to the gas generator 20, the gas generator 20 feeds an inflation gas to the airbag 13, so that the airbag 13 is deployed as shown in FIGS. 6 to 9.

The protector P in accordance with the exemplary embodiment is easy to put on since it is configured to be put on the wearer through the use of the mounting belt 1. Moreover, in the protector P in accordance with the exemplary embodiment, the protective bodies 7 (7L, 7R) extend from the mounting belt 1 so as to protect the bases of the femurs TB (i.e. the trochanters TP of femurs) and surroundings of the wearer M. Each of the protective bodies 7 includes the protective pad 10 and the airbag 13 (or bag body 16) that is overlaid on the outer surface (on the surface facing away from the wearer M in a worn state) of the protective pad 10 in a stacking manner, and is configured to protect the targeted body part (the trochanter TP of femur, in this specific embodiment) of the wearer M with the protective pad 10 and the airbag 13 as inflated. Further, at least a part of the outer circumferential edge (the upper end 16*a* and lower end 16*b*, in this embodiment) of the bag body 16 of the airbag 13 is joined to the protective pad 10, so that the airbag 13 as inflated will cover the outside of the protective pad 10 in a state it is prevented from floating away from the protective pad 10, as can be seen in FIG. 9. With this configuration, although the protective bodies 7 are configured to extend from the mounting belt 1, each of the bag bodies 16 will be deployed over the protective pad 10 steadily without floating away from the protective pad 10, so that the protector P will be able to cover the trochanters TP of femurs of the wearer M steadily with the protective pads 10 and the bag bodies 16. Furthermore, the outer cover 25 that stores the protective pads 10 and airbag 13 therein makes the appearance of the protector P good. In the protector P in accordance with the exemplary embodiment, moreover, the protective pads 10 are configured to protect the bases of femurs TB (i.e. the trochanters TP of femurs) and surroundings. The targeted body part will be protected by the protective pad 10 in case the airbags 13 fail to be inflated.

Therefore, the protector P in accordance with the exemplary embodiment is easy to put on, and is able to protect the targeted body part of the wearer M steadily.

In the protector P in accordance with the exemplary embodiment, the lower end 16*b* of the airbag 13 (bag body 16) is joined to the protective pad 10. In other words, a far-side end 16*b*, which is apart from the mounting belt 1, of the airbag 13 is joined to the protective pad 10. This configuration will reliably prevent the far-side end (i.e. lower end) 16*b* of the airbag 13 (bag body 16) from floating away from the protective pad 10 at airbag deployment. In one or more embodiments, the airbag may be joined to the protective pad by the side edges (front edge and rear edge) in a vicinity of the lower end, instead of the lower end itself.

In the protector P in accordance with the exemplary embodiment, the upper end 16*a* of the airbag 13 (bag body 16) is also joined to the protective pad 10. In other words, a near-side end 16*a*, which is close to the mounting belt 1, of the airbag 13 is joined to the protective pad 10. That is, each of the bag bodies 16 is joined to the protective pad 10 by both of the upper end 16*a* and lower end 16*b*. This configuration will prevent also the near-side end (i.e. upper end) 16*a* of the airbag 13 (bag body 16) from floating away from the protective pad 10 at airbag deployment, so that the airbag 13 (or bag body 16) will be able to cover the outer surface (the surface facing away from the wearer M in a worn state) of the protective pad 10 steadily and amply in the up and down direction. If such an advantageous effect does not have to be considered, the airbag may be joined to the protective pad only by the lower end.

In the protector P in accordance with the exemplary embodiment, furthermore, each of the upper end 16*a* and lower end 16*b* of the airbag (or bag body 16) is disposed on the inner surface 10*c* of the protective pad 10 while enfolding each of opposite terminals of the protective pad 10, and joined to the protective pad 10 on the inner surface 10*c* of the protective pad 10. This configuration will increase a substantial joined area of the upper end 16*a* and lower end 16*b* of the bag body 16 to the protective pad 10, compared to an instance where the upper end 16*a* and lower end 16*b* of the airbag 13 are joined to the protective pad 10 on the outer surface of the protective pad 10, and help inflate the airbag 13 (or bag body 16) in proximity to the protective pad 10 over a wide area. In other words, the above configuration will help inflate the airbag 13 (bag body 16) along the protective pad 10 over an entire area in the up and down direction. If such an advantageous effect does not have to be considered, the end(s) of the airbag may be joined to the protective pad on the outer surface of the protective pad, without enfolding the terminals of the protective pad.

Figure 10:
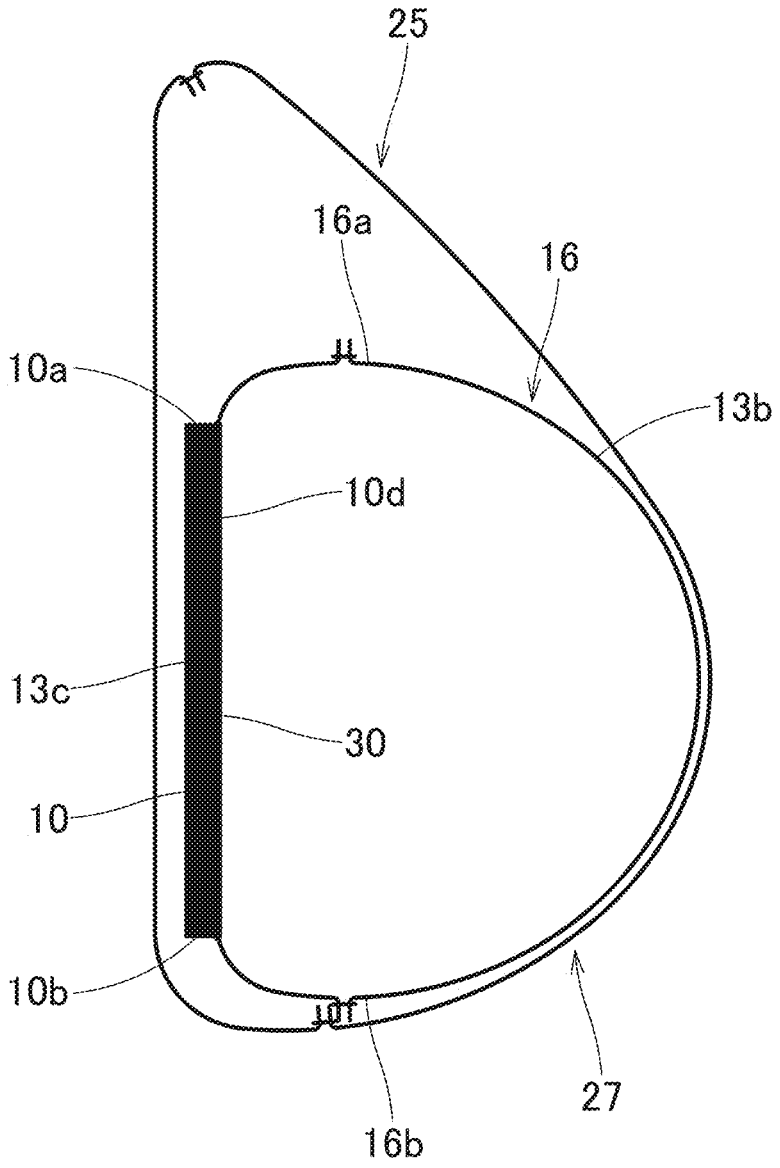
FIG. 10 is a schematic vertical sectional view of a modification of the protector of the exemplary embodiment at full inflation of the airbag.

Alternatively, the airbag 13 may be adhered to the outer surface 10*d* of the protective pad 10 by an entire inner wall 13*a* of the bag body 16 with an adhesive layer 30 of adhesive, as illustrated in FIG. 10. This configuration will also help deploy the bag body 16 along the protective pad 10 over the entire area in the up and down direction.

In the foregoing embodiment, the protector P is configured to be put on around the hip MW of the wearer M through the use of the mounting belt 1, and aims to cover outer sides of the bases of the left and right femurs TB (i.e. the trochanters TP of femurs) with the two protective bodies 7 (7L, 7R) extending downward from the mounting belt 1. The protector P is able to protect these targeted body parts steadily with the two protective bodies 7 (7L, 7R), thus prevents fractures of the femur TB upon fall that may take a long time to treat. Thus, the protector P in accordance with the exemplary embodiment will be suitable for use by elderly people.

The invention should not be limited to the exemplary embodiments disclosed above. By way of example, the invention may be applied to a protector that aims to protect such targeted body part as the shoulder, the elbow and knee of the wearer, and is configured to be mounted on a body part in a vicinity of the targeted body part with the use of the mounting belt.

The protector in accordance with the exemplary embodiment is adapted to be worn by a wearer for protecting a targeted body part of the wearer. The protector includes a mounting belt that is adapted to put on the body of the wearer, and at least one protective body that is adapted to cover the targeted body part when the protector is worn, the protective body extending from the mounting belt. The protective body includes: a protective pad that substantially has a board shape; an airbag that is overlaid on an outer surface of the protective pad in a stacking manner, the airbag being configured to be inflated with an inflation gas when the protector is actuated; and an outer cover that covers outer circumferences of the protective pad and the airbag as stacked one on another. At least a part of an outer circumferential edge of the airbag is joined to the protective pad so that the airbag will not float away from the protective pad when inflated.

The protector in accordance with the exemplary embodiment is easy to put on since it is configured to be put on the wearer through the use of the mounting belt. Moreover, in the protector in accordance with the exemplary embodiment, the protective body for protecting the targeted body part extends from the mounting belt, and includes the protective pad and the airbag that is overlaid on the outer surface (on the surface facing away from the wearer in a worn state) of the protective pad in a stacking manner. The protector is configured to protect the targeted body part of the wearer with the protective pad and the airbag as inflated. Further, at least a part of the outer circumferential edge of the airbag is joined to the protective pad, so that the airbag as inflated will cover the outside of the protective pad in a state it is prevented from floating away from the protective pad. With this configuration, although the protective body is configured to extend from the mounting belt, the airbag will be deployed over the protective pad steadily without floating away from the protective pad, so that the protector will be able to cover the targeted body part of the wearer steadily with the protective pad and the airbag. Furthermore, the outer cover that covers the protective pad and airbag makes the appearance of the protector good. In the protector in accordance with the exemplary embodiment, moreover, the protective pad is configured to protect the targeted body part. The targeted body part will be protected by the protective pad in case the airbag fails to be inflated.

Therefore, the protector in accordance with the exemplary embodiment is easy to put on, and is able to protect the targeted body part of the wearer steadily.

In one or more embodiments, the airbag may be joined to the protective pad by its far-side end which is apart from the mounting belt. This configuration will reliably prevent the far-side end of the airbag which is apart from the mounting belt from floating away from the protective pad at airbag deployment.

In one or more embodiments, the airbag may be joined to the protective pad also by its near-side end which is close to the mounting belt. This configuration will prevent also the near-side end of the airbag from floating away from the protective pad at airbag deployment, so that the airbag will be able to cover the outer surface (the surface facing away from the wearer in a worn state) of the protective pad steadily and amply in an up and down direction.

In one or more embodiments, the airbag may be adhered to the protective pad substantially by an entirety of its surface facing the protective pad.

In one or more embodiments, the at least a part of the outer circumferential edge of the airbag may be disposed on an inner surface of the protective pad while enfolding a terminal of the protective pad, and joined to the protective pad on the inner surface of the protective pad. This configuration will increase a substantial joined area of the at least a part of the outer circumferential edge of the airbag to the protective pad, compared to an instance where the outer circumferential edge of the airbag is joined to the protective pad on the outer surface of the protective pad, and help inflate the airbag in proximity to the protective pad over a wide area. In other words, the above configuration will help inflate an entirely of the airbag along the protective pad.

In one or more embodiments, the mounting belt may be configured to be put on around the hip of the wearer, and the protective bodies may be formed to extend downward from two places of the mounting belt so as to cover outer sides of the bases of the left and right femurs of the wearer. The protector thus configured will be able to protect the bases of left and right femurs and surroundings steadily with the two protective bodies, thus prevent fractures of the femur of the wearer such as an elderly person upon fall that may take a long time to treat.

What is claimed is:

1. A protector adapted to be worn by a wearer for protecting a targeted body part of the wearer, the protector comprising:

a mounting belt that is adapted to put on the body of the wearer; and at least one protective body that is adapted to cover the targeted body part when the protector is worn, the protective body extending from the mounting belt, wherein the protective body includes:

a protective pad that substantially has a board shape;

an airbag that is overlaid on an outer surface of the protective pad in a stacking manner, the airbag being configured to be inflated with an inflation gas when the protector is actuated; and an outer cover that covers outer circumferences of the protective pad and the airbag as stacked one on another;

wherein at least a part of an outer circumferential edge of the airbag is joined to the protective pad so that the airbag will not float away from the protective pad when inflated;

wherein the protector further comprises a gas generator configured to feed the airbag with the inflation gas, and an operation control device which is configured to actuate the gas generator; and wherein the gas generator is configured to be actuated when the operation control device detects a falling behavior of the wearer.

2. The protector of claim 1, wherein:

the airbag includes a far-side end that is apart from the mounting belt and a near-side end that is close to the mounting belt; and the airbag is joined to the protective pad by the far-side end.

3. The protector of claim 2, wherein the airbag is joined to the protective pad also by the near-side end.

4. The protector of claim 3, wherein each of the far-side end and near-side end of the airbag is disposed on an inner surface of the protective pad while enfolding each of opposite terminals of the protective pad, and joined to the protective pad on the inner surface of the protective pad.

5. The protector of claim 4, wherein:

the mounting belt is configured to be put on around the hip of the wearer; and the at least one protective body extends downward from two places of the mounting belt so as to cover outer sides of the bases of the left and right femurs of the wearer.

6. The protector of claim 3, wherein:

the mounting belt is configured to be put on around the hip of the wearer; and the at least one protective body extends downward from two places of the mounting belt so as to cover outer sides of the bases of the left and right femurs of the wearer.

7. The protector of claim 2, wherein the far-side end of the airbag is disposed on an inner surface of the protective pad while enfolding a terminal of the protective pad, and joined to the protective pad on the inner surface of the protective pad.

8. The protector of claim 7, wherein:

the mounting belt is configured to be put on around the hip of the wearer; and the at least one protective body extends downward from two places of the mounting belt so as to cover outer sides of the bases of the left and right femurs of the wearer.

9. The protector of claim 2, wherein:

the mounting belt is configured to be put on around the hip of the wearer; and the at least one protective body extends downward from two places of the mounting belt so as to cover outer sides of the bases of the left and right femurs of the wearer.

10. The protector of claim 1, wherein the airbag is adhered to the protective pad substantially by an entirety of a surface thereof facing the protective pad.

11. The protector of claim 10, wherein:

the mounting belt is configured to be put on around the hip of the wearer; and the at least one protective body extends downward from two places of the mounting belt so as to cover outer sides of the bases of the left and right femurs of the wearer.

12. The protector of claim 1, wherein the at least a part of the outer circumferential edge of the airbag is disposed on an inner surface of the protective pad while enfolding a terminal of the protective pad, and joined to the protective pad on the inner surface of the protective pad.

13. The protector of claim 12, wherein:

the mounting belt is configured to be put on around the hip of the wearer; and the at least one protective body extends downward from two places of the mounting belt so as to cover outer sides of the bases of the left and right femurs of the wearer.

14. The protector of claim 1, wherein:

the mounting belt is configured to be put on around the hip of the wearer; and the at least one protective body extends downward from two places of the mounting belt so as to cover outer sides of the bases of the left and right femurs of the wearer.

* * * * *